US005787997A

United States Patent [19]

Hartmann

[11] Patent Number: 5,787,997

[45] Date of Patent: Aug. 4, 1998

[54] METHOD OF QUALIFYING A BOREHOLE SURVEY

[75] Inventor: Robin Adrianus Hartmann, Rijswijk, Netherlands

[73] Assignee: Shell Oil Company, Houston, Tex.

[21] Appl. No.: 752,988

[22] Filed: Nov. 21, 1996

[30] Foreign Application Priority Data

Nov. 21, 1995 [EP] European Pat. Off. ..... 95203200

[51] Int. Cl.[6] ..... E21B 47/022; E21B 47/024

[52] U.S. Cl. ..... 175/45; 175/50

[58] Field of Search ..... 175/45, 50, 61, 175/40; 33/302, 304

[56] References Cited

U.S. PATENT DOCUMENTS

| | | | |
|---|---|---|---|
| 4,682,421 | 7/1987 | van Dongen et al. | 33/302 |
| 4,710,708 | 12/1987 | Rorden et al. | 324/207.26 |
| 4,761,889 | 8/1988 | Cobern et al. | 33/302 |
| 4,957,172 | 9/1990 | Patton et al. | 175/61 |
| 5,103,920 | 4/1992 | Patton | 175/45 |
| 5,155,916 | 10/1992 | Engebretson | 33/302 |
| 5,452,518 | 9/1995 | DiPersio | 33/304 |

FOREIGN PATENT DOCUMENTS

| | | |
|---|---|---|
| 193230 | 3/1990 | European Pat. Off. . |
| 384537 | 8/1990 | European Pat. Off. . |
| 654686 | 5/1995 | European Pat. Off. . |

*Primary Examiner*—Frank Tsay

[57] ABSTRACT

A method of qualifying a survey of a borehole formed in an earth formation is provided. The method includes the steps of a) selecting a sensor for measuring an earth field parameter and a borehole position parameter in said borehole, b) determining theoretical measurement uncertainties of said parameters when measured with the sensor, c) operating said sensor so as to measure the position parameter and the earth field parameter at a selected position in the borehole, d) determining the difference between the measured earth field parameter and a known magnitude of said earth field parameter at said position, and determining the ratio of said difference and the theoretical measurement uncertainty of the earth field parameter, and e) determining the uncertainty of the measured position parameter from the product of said ratio and the theoretical measurement uncertainty of the position parameter.

13 Claims, 2 Drawing Sheets

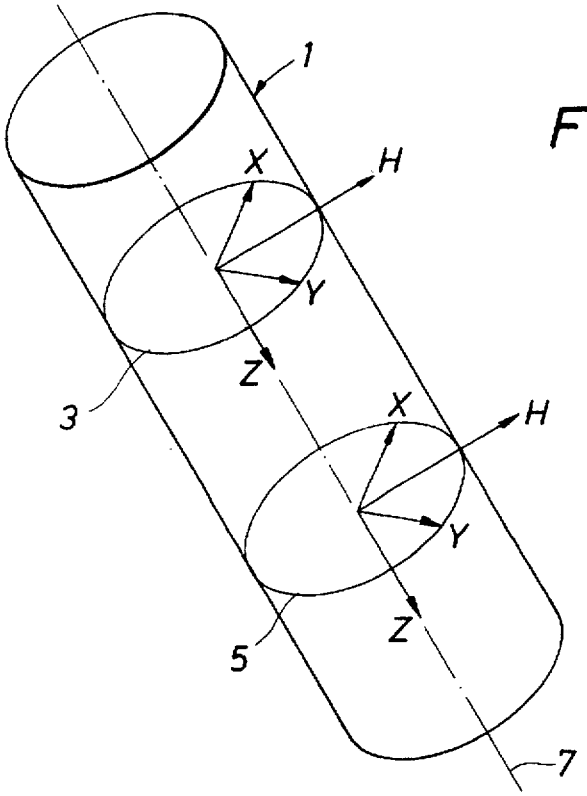
FIG. 1
FIG. 2
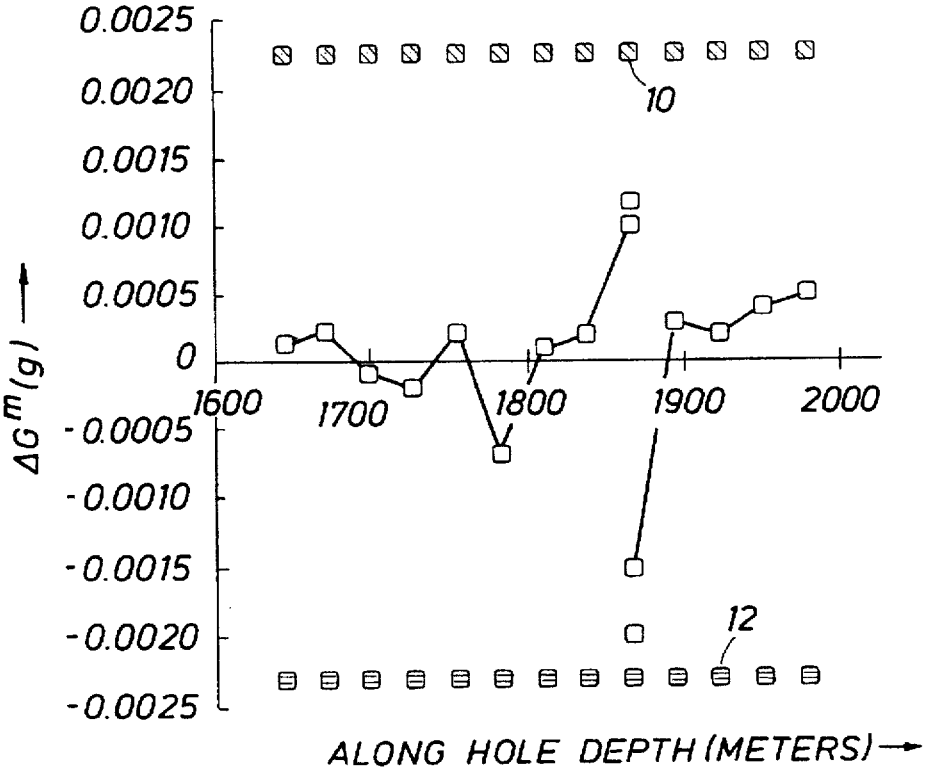

METHOD OF QUALIFYING A BOREHOLE SURVEY

FIELD OF THE INVENTION

The present invention relates to a method of qualifying a survey of a borehole formed in an earth formation.

BACKGROUND TO THE INVENTION

In the field of wellbore drilling, e.g. for the purpose of hydrocarbon exploitation, it is common practice to measure the course of the wellbore as drilling proceeds in order to ensure that the final target zone in the earth formation is reached. Such measurements can be conducted by using the earth gravity field and the earth magnetic field as references, for which purpose accelerometers and magnetometers are incorporated in the drill string, at regular mutual distances. Although these sensors in most cases provide reliable results, a second, independent, measurement is generally considered necessary. The independent measurement is commonly carried out using a gyroscope which is lowered into the borehole after setting of casing in the borehole. Such procedure is costly and time consuming, and it would be desirable to provide a method which obviates the need for conducting independent gyroscopic measurements.

It is therefore an object of the invention to provide a method of qualifying a survey of a borehole formed in an earth formation, which method obviates the need for conducting a second, independent, borehole survey.

SUMMARY OF THE INVENTION

These and other objectives are accomplished by a method of qualifying a survey of a borehole formed in an earth formation, the method comprising:

a) selecting a sensor for measuring an earth field parameter and a borehole position parameter in said borehole;

b) determining theoretical measurement uncertainties of said parameters when measured with the sensor;

c) operating said sensor so as to measure the position parameter and the earth field parameter at a selected position in the borehole;

d) determining the difference between the measured earth field parameter and a known magnitude of said earth field parameter at said position, and determining the ratio of said difference and the theoretical measurement uncertainty of the earth field parameter; and e) determining the uncertainty of the measured position parameter from the product of said ratio and the theoretical measurement uncertainty of the position parameter.

The earth field parameter can, for example, be the earth gravity or the earth magnetic field strength, and the borehole position parameter can, for example, be the borehole inclination or the borehole azimuth.

The ratio of the difference between the measured earth field parameter and a known magnitude of said earth field parameter at said position, and the theoretical measurement uncertainty of the position parameter, forms a preliminary check on the quality of the survey. If the measured earth field parameter is within the measurement tolerance of this parameter, i.e. if the ratio does not exceed the magnitude 1, then the survey is at least of acceptable quality. If the ratio exceeds magnitude 1, the survey is considered to be of poor quality. Thus the ratio forms a preliminary measure for the quality of the survey, and the product of this ratio and the theoretical measurement uncertainty of the position parameter (as determined in step d) forms the best guess of the survey quality.

BRIEF DESCRIPTION OF THE FIGURES

FIG. 1 shows schematically a solid state magnetic survey tool.

FIG. 2 shows a diagram of the difference between the measured and known gravity field strength in an example borehole, against the along borehole depth.

DESCRIPTION OF A PREFERRED EMBODIMENT

Figure 3:
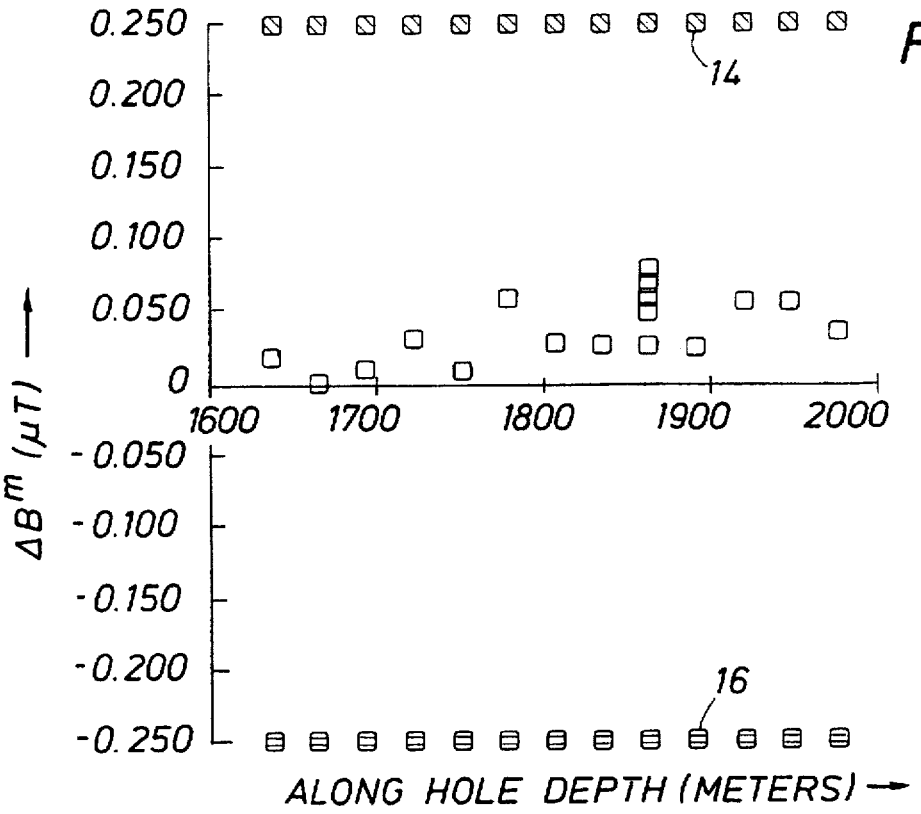
FIG. 3 shows a diagram of the difference between the measured and known magnetic field strength in the example borehole, against the along borehole depth.

Referring to FIG. 1 there is shown a solid state magnetic survey tool 1 which is suitable for use in the method according to the invention. The tool includes a plurality of sensors in the form of a triad of accelerometers 3 and a triad of magnetometers 5 whereby for ease of reference the individual accelerometers and magnetometers are not indicated, only their respective mutual orthogonal directions of measurement X, Y and Z have been indicated. The triad of accelerometers measure acceleration components and the triad of magnetometers 5 measure magnetic field components in these directions. The tool 1 has a longitudinal axis 7 which coincides with the longitudinal axis of a borehole (not shown) in which the tool 1 has been lowered. The high side direction of the tool 1 in the borehole is indicated as H.

During normal use of the tool 1, the tool 1 is incorporated in a drill string (not shown) which is used to deepen the borehole. At selected intervals in the borehole, the tool 1 is operated so as to measure the components in X, Y and Z directions of the earth gravity field G and the earth magnetic field B. From the measured components of G and B, the magnitudes of the magnetic field dip-angle D, the borehole inclination I and the borehole azimuth A are determined in a manner well-known in the art. Before further processing these parameters, the theoretical uncertainties of G, B, D, I and A are determined on the basis of calibration data representing the class of sensors to which the sensors of the tool 1 pertains (i.e. bias, scale factor offset and misalignment), the local earth magnetic field variations, the planned borehole trajectory and the running conditions of the sensor such as corrections applied to raw measurement data. Because the theoretical uncertainties of G, B, D, I and A depend mainly on the accuracy of the sensors and the uncertainties of the earth field parameters due to slight variations thereof, the total theoretical uncertainty of each one of these parameters can be determined from the sum of the theoretical uncertainties due to the sensor and the variation of the earth field parameter. In this description the following notation is used:

$dG^{th,s}$=theoretical uncertainty of gravity field strength G due to the sensor uncertainty;

$dB^{th,s}$=theoretical uncertainty of magnetic field strength B due to the sensor uncertainty;

$dD^{th,s}$=theoretical uncertainty of dip-angle due to the sensor uncertainty;

$dB^{th,g}$=theoretical uncertainty of magnetic field strength B due to the geomagnetic uncertainty;

$dD^{th,g}$=theoretical uncertainty of dip-angle due to the geomagnetic uncertainty;

$dI^{th,s}$=theoretical uncertainty of borehole inclination I due to the sensor uncertainty;

$dA^{th,s}$=theoretical uncertainty of borehole azimuth A due to the sensor uncertainty;

$dA^{th,g}$=theoretical uncertainty of borehole azimuth A due to the geomagnetic uncertainty;

In a next phase the uncorrected gravity and magnetic field data obtained from the measurement are corrected for axial and cross-axial magnetic interference and tool face dependent misalignment. A suitable correction method is disclosed in EP-B-0193230, which correction method uses as input data the local expected magnetic field strength and dip-angle, and which provides output data in the form of corrected gravity field strength, magnetic field strength and dip-angle. These corrected earth field parameter values are compared with the known local values thereof, and for each parameter a difference between the computed value and the known value is determined.

Figure 4:
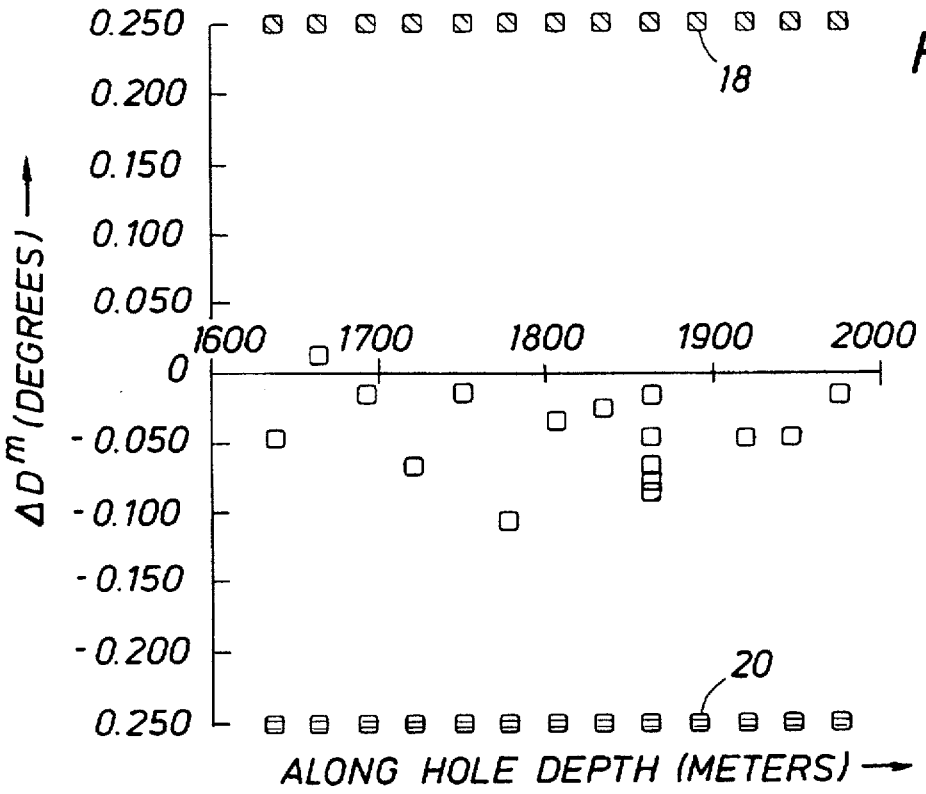
FIG. 4 shows a diagram of the difference between the measured and known dip-angle in the example borehole, against the along borehole depth.

A preliminary assessment of the quality of the survey is achieved by comparing the differences between the corrected measured values and the known values of the earth field parameters G, B and D with the measurement uncertainties of G, B and D referred to above. For a survey to be of acceptable quality, said difference should not exceed the measurement uncertainty. In FIGS. 2, 3 and 4 example results of a borehole survey are shown. FIG. 2 shows a diagram of the difference $\Delta G^m$ between the corrected measured value and the known value of G, against the along borehole depth. FIG. 3 shows a diagram of the difference $\Delta B^m$ between the corrected measured value and the known value of B, against the along borehole depth. FIG. 4 shows a diagram of the difference $\Delta D^m$ between the corrected measured value and the known value of D, against the along borehole depth. The measurement uncertainties of the earth field parameters in this example are:

uncertainty of G=dG=0.0023 g (g being the acceleration of gravity);

uncertainty of B=dB=0.25 μT;

uncertainty of D=dD=0.25 degrees.

These measurement uncertainties are indicated in the Figs. in the form of upper and lower boundaries 10, 12 for G, upper and lower boundaries 14, 16 for B, and upper and lower boundaries 18, 20 for D. As shown in the Figures, all values of $\Delta G^m$, $\Delta B^m$ and $\Delta D^m$ are within the respective measurement uncertainties, and therefore these values are considered acceptable.

To determine the uncertainty of the position parameters I and A as derived from the measured earth field parameters G, B and D, the following ratios are first determined:

$\Delta G^m/dG^{th,s}$ $\Delta B^m/dB^{th,s}$ $\Delta D^m/dD^{th,s}$ $\Delta B^m/dB^{th,g}$ $\Delta D^m/dG^{th,g}$ wherein $\Delta G^m$=difference between the corrected measured value and the known value of G;

$\Delta B^m$=difference between the corrected measured value and the known value of B;

$\Delta D^m$=difference between the corrected measured value and the known value of D;

To compute the measured inclination uncertainty it is assumed that the above indicated ratio of the gravity field strength $\Delta G^m/dG^{th,s}$ represents the level of all sources of uncertainties contributing to an inclination uncertainty. If, for example, at a survey station in the drill string the ratio equals 0.85 then it is assumed that all sensor uncertainties in the drillstring are at a level of 0.85 times $dI^{th,s}$. Therefore the measured inclination uncertainty for all survey stations in the drillstring is:

$\Delta I^m=abs[(\Delta G^m/dG^{th,s})dI^{th,s}]$ wherein $\Delta I^m$=measured inclination uncertainty due to sensor uncertainty.

The measured azimuth uncertainty is determined in a similar way, however two sources of uncertainty (sensor and geomagnetic) may have contributed to the azimuth uncertainty. For each source two ratios i.e. magnetic field strength and dip-angle are derived, resulting in four measured azimuth uncertainties:

$\Delta A^{s,B}=abs[(\Delta B^m/dB^{th,s})dA^{th,s}]$ $\Delta A^{s,D}=abs[(\Delta D^m/dD^{th,s})dA^{th,s}]$ $\Delta A^{g,B}=abs[(\Delta B^m/dB^{th,g})dA^{th,g}]$ $\Delta A^{g,D}=abs[(\Delta D^m/dD^{th,g})dA^{th,g}]$ The measured azimuth uncertainty $\Delta A^m$ is taken to be the maximum of the these values i.e.:

$\Delta A^m=max[\Delta A^{s,B}; \Delta A^{s,D}; \Delta A^{g,B}; \Delta A^{g,D}]$.

From the measured inclination and azimuth uncertainties, the lateral position and upward position uncertainties can be derived. These position uncertainties are usually determined using a covariance approach. For the sake of simplicity the following more straightforward method can be applied:

$LPU_i=LPU_{i-1}+(AHD_i-AHD_{i-1})(\Delta A_i^m \sin I_i^m+\Delta A_{i-1}^m \sin I_{i-1}^m)/2$;

and $UPU_i=UPU_{i-1}+(AHD_i-AHD_{i-1})(\Delta I_i^m+\Delta I_{i-1}^m)/2$.

wherein $LPU_i$=lateral position uncertainty at location i $AHD_i$= along hole depth at location i $\Delta A_{im}$=measured azimuth uncertainty at location i $\Delta I_{im}$=measured inclination uncertainty at location i $UPU_i$=upward position uncertainty at location i.

The lateral position uncertainties and the upward position uncertainties thus determined are then compared with the theoretical lateral and upward position uncertainties (derived from the theoretical inclination and azimuth uncertainties) to provide an indicator of the quality of the borehole survey.

We claim:

1. A method of qualifying a survey of a borehole formed in an earth formation, the method comprising:

a) selecting a sensor for measuring an earth field parameter and a borehole position parameter in said borehole;

b) determining theoretical measurement uncertainties of said parameters when measured with the sensor;

c) operating said sensor so as to measure the position parameter and the earth field parameter at a selected position in the borehole;

d) determining the difference between the measured earth field parameter and a known magnitude of said earth field parameter at said position, and determining the ratio of said difference and the theoretical measurement uncertainty of the earth field parameter; and e) determining the uncertainty of the measured position parameter from the product of said ratio and the theoretical measurement uncertainty of the position parameter.

2. The method of claim 1, wherein said sensor comprises a solid state magnetic survey tool including at least one magnetometer and at least one accelerometer.

3. The method of claim 2, wherein the solid state magnetic survey tool comprises three magnetometers and three accelerometers.

4. The method of claim 1 wherein the step of determining theoretical measurement uncertainties of said parameters comprises determining the theoretical measurement uncertainties of a group of sensors to which the selected sensor pertains.

5. The method of claim 1 wherein said theoretical measurement uncertainties are based on at least one of the sensor uncertainty and an uncertainty of the earth field parameter.

6. The method of claim 1 further comprising the step of disqualifying the measurements if said ratio exceeds 1.

7. The method of claim 1 wherein said position parameter is selected from the borehole inclination and the borehole azimuth.

8. The method of claim 7, wherein in a first mode of operation the position parameter forms the borehole inclination, the earth field parameter forms the earth gravity field, and the theoretical uncertainties of the position parameter and the earth field parameter are based on the sensor uncertainty.

9. The method of claim 7 wherein in a second mode of operation the position parameter forms the borehole azimuth, the earth field parameter forms the earth magnetic field strength, and the theoretical uncertainties of the position parameter and the earth field parameter are based on the sensor uncertainty.

10. The method of claim 7 wherein in a third mode of operation the position parameter forms the borehole azimuth, the earth field parameter forms the earth magnetic field strength, and the theoretical uncertainties of the position parameter and the earth field parameter are based on the uncertainty of the earth magnetic field.

11. The method of claim 7 wherein in a fourth mode of operation the position parameter forms the borehole azimuth, the earth field parameter forms the dip-angle of the earth magnetic field, and the theoretical uncertainties of the position parameter and the earth field parameter are based on the sensor uncertainty.

12. The method of claim 7 wherein in a fifth mode of operation the position parameter forms the borehole azimuth, the earth field parameter forms the dip angle of the earth magnetic field, and the theoretical uncertainties of the position parameter and the earth field parameter are based on the uncertainty of the earth field parameter.

13. The method of claim 9 wherein the step of determining the uncertainty of the measured position parameter comprises determining the maximum absolute value of the uncertainties of the measured position parameters determined in the second, third, fourth and fifth mode of operation.

* * * * *